US011566512B2

(12) United States Patent
Fischer

(10) Patent No.: US 11,566,512 B2
(45) Date of Patent: Jan. 31, 2023

(54) METHOD FOR DETERMINING WEAR ON A LINKAGE OF A GROUND DRILLING DEVICE

(71) Applicant: TRACTO-TECHNIK GmbH & Co. KG, Lennestadt (DE)

(72) Inventor: Sebastian Fischer, Lennestadt (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 241 days.

(21) Appl. No.: 16/103,216

(22) Filed: Aug. 14, 2018

(65) Prior Publication Data

US 2019/0055831 A1 Feb. 21, 2019

(30) Foreign Application Priority Data

Aug. 18, 2017 (DE) ..... 102017118853.3

(51) Int. Cl.
*E21B 47/007* (2012.01)
*E21B 47/01* (2012.01)
*E21B 47/017* (2012.01)

(52) U.S. Cl.
CPC ..... *E21B 47/007* (2020.05); *E21B 47/01* (2013.01); *E21B 47/017* (2020.05)

(58) Field of Classification Search
CPC ..... E21B 47/007; E21B 47/017; E21B 47/01
See application file for complete search history.

(56) References Cited

U.S. PATENT DOCUMENTS

| | | | | |
|---|---|---|---|---|
| 4,547,833 | A * | 10/1985 | Sharp | E21B 47/017 361/716 |
| 4,715,451 | A | 12/1987 | Bseisu et al. | |
| 6,021,377 | A | 2/2000 | Dubinsky et al. | |
| 8,863,859 | B2 * | 10/2014 | Koch | E21B 47/01 175/39 |
| 9,771,794 | B2 * | 9/2017 | Gajji | E21B 17/006 |
| 2016/0047223 | A1 * | 2/2016 | Li | E21B 47/007 702/9 |
| 2017/0306748 | A1 * | 10/2017 | Marland | E21B 44/005 |

FOREIGN PATENT DOCUMENTS

| | | | |
|---|---|---|---|
| DE | 102008052510 | B3 | 7/2010 |
| DE | 112013007353 | T5 | 4/2016 |
| WO | 2010046099 | A1 | 4/2010 |
| WO | 2015026332 | A1 | 2/2015 |

OTHER PUBLICATIONS

"Model predicts drill pipe fatigue in horizontal wells" Jiang Wu; Oil and Gas Journal, Feb. 3, 1997; pp. 47-48 and 51-53.

* cited by examiner

*Primary Examiner* — David Z Huang
(74) *Attorney, Agent, or Firm* — Howard IP Law Group, PC

(57) ABSTRACT

A method for determining the wear on a linkage of a ground drilling device includes detecting a bending load of the linkage. The bending load is used to carry out a service life calculation.

12 Claims, 2 Drawing Sheets

METHOD FOR DETERMINING WEAR ON A LINKAGE OF A GROUND DRILLING DEVICE

CROSS-REFERENCE TO RELATED APPLICATION

This application claims priority benefit under 35 U.S.C. § 119 to German Application No. 10 2017 118 853.3 filed Aug. 18, 2017, the entirety of which is incorporated herein by reference for all purposes.

FIELD OF THE INVENTION

The invention relates to a method for determining the wear on a linkage of a ground drilling device and a ground drilling device with a linkage section. Furthermore, the invention relates to a usage in a ground drilling device for determining the wear on a linkage of the ground drilling device.

BACKGROUND

Ground drilling devices usually comprise a drive device and a linkage connected to it, on which linkage a drilling head, which can be designed as a tool, can be fastened. The drilling head can be a widening head or a pipe taking-in adapter. The drive forces of the drive device are transferred via the linkage onto the drilling head, as a result of which the latter is driven into the earth. For a boring operation of the ground drilling device, as a rule pressure forces are applied onto the drilling head so that it is moved in a pushing manner through the ground. However, the concept "introduction of a ground borehole" by the ground drilling device also includes a transfer of tractive forces onto the linkage and onto the drilling head. In the transfer of tractive forces by the linkage onto the drilling head, an existing bore is usually widened, an existing old line is shattered and/or a new pipe is drawn into an existing bore or old line. The linkage of a ground drilling device usually consists of a plurality of interconnected linkage lengths which are successively connected to each other (in a pushing operation) or are separated from one another (in a drawing operation) according to the advance of the drilling head in the ground area. A connection between the linkage lengths can take place, for example, by screw connections or by plug couplings. Mixed connections consisting of screw connections and plug couplings are possible.

In the transfer of drive forces onto the drilling head on the linkage, linear drives are almost exclusively used which transfer the drive forces or drive movements step-by-step onto the linkage, i.e., with a load stroke in which the linkage is connected to the linear drive and with a return stroke in which the connection between the linear drive and the linkage is loosened. Customary linear drives for ground drilling devices operate with hydraulic cylinders as the drive source, wherein high forces can be applied by them with comparatively compact dimensions. In addition, linear drives with toothed rack drives are also known.

The expected service life of basically all components of these devices, in particular of the linkage, which are moved through the ground area is difficult to estimate. This can be traced back in particular to the fact that the service life of the components in addition to the geometric dimensions and the materials used is essentially a function of how they are loaded. To this end DE 10 2008 052 510 B3 suggests providing a measuring device for measuring the instantaneous load on the linkage in which, in order to determine the instantaneous load on the linkage, the operating forces of the drive connected to the linkage are measured.

It turned out that the known ascertaining of the determination of the instantaneous load of the linkage with which a calculation of the service life can be made can at times deliver a result which can deviate from the real service life.

Starting from this prior art, the invention had the problem of increasing the operational safety of a ground drilling device and/or improving service life calculations of a linkage of a ground drilling device.

This problem is solved by the subject matter disclosed herein. Advantageous embodiments are also set forth in the following description of the invention.

SUMMARY

The core of the invention provides detecting bending loads of the linkage in order to improve a calculation of the service life and/or to increase the operational safety of a ground drilling device, wherein the load can be determined in particular not on the drive device but rather in the ground borehole itself in that a course of the ground borehole, in particular a curved range of the ground borehole itself, can be detected.

A method for determining the wear on a linkage of a ground drilling device therefore provides that a bending load of the linkage is detected in order to carry out a calculation of the service life.

It was recognized for the first time that a loading is also determined substantially additionally to the drive device and that a loading is determined in the ground bore itself. The loading can be detected in the ground bore and taken into account for the calculating of the service life. The prevailing opinion that the linkage lengths are exposed exclusively to the loading by the drive device and only the loading of the drive device is determined was supplemented according to the invention.

The concept "linkage" does not exclusively comprise in the sense of the specification rigid, individual linkages comprising linkage lengths which are directly or indirectly connected to each other but rather in particular all force transmission elements which can be used in a ground drilling device. In addition, the concept "linkage" should not denote only the force transfer element which is arranged between the drive device of the ground drilling device and the drilling head but rather basically all components of a drill string, i.e., all components which are moved in the ground area of such a ground drilling device which are exposed to a loading by forces and/or moments applied by the drive device. The umbrella concept "linkage" can also include the drilling head as part of the drill string.

The concept "drive device" comprises in the sense of the specification a drive with which the drive forces or drive movements are transferred onto the linkage or the drill string. In a preferred embodiment the drive device can be designed as a linear drive. The drive device can also be designed as a toothed rack drive. The drive device can comprise hydraulic cylinders as drive source.

In a preferred embodiment the bending load on the linkage is measured by a linkage section on which at least one expansion sensor is present. It was recognized that a recognition of the load independently of the drive device of the ground drilling device is required but this load does not necessarily have to be carried out by a measuring procedure on each linkage section or on a linkage length but rather in a representative manner on one or more linkage sections which are arranged in the drill string or linkage and which can be associated with the linkage lengths.

In addition to a bending loading of the linkage lengths on the linkage, machine data of the drive device can be used from which at least one more piece of information can be derived from the following machine data in order to carry out the calculation of the service life: torsion, traction loading, thrust loading and rotational speed. The torsion loading, traction loading/pressure loading and/or rotational speed of the individual linkage lengths can then be determined from the machine data of the drive device.

In a preferred embodiment the bending load is detected by a wire strain gauge, a fiber-Bragg grating sensor or the like. This makes it possible to use robust and proven sensors or detection elements which can also be used under the harsh conditions in the ground area.

In a preferred embodiment the calculation of the service life is associated with individual linkage lengths of the linkage. This makes it possible that not only a general statement about the linkage lengths of the linkage present in the ground area is possible but rather the load can be indicated for each individual linkage length. It can be taken into consideration how long and at which position length is located in the linkage. Therefore, it can be taken into consideration as regards the bending load, which linkage length was exposed to a bending load or whether, for example, a linkage length has not (yet) run through a curved area of the ground bore. Therefore, the bending load can be taken into consideration in accordance with the position of the linkage length in the linkage.

Therefore, the described method is especially well-suited in particular for determining the wear on the linkage which comprises a plurality of linkage lengths which are connected to each other. The individual loads of individual or of all of the linkage lengths are preferably measured here and individual calculations of service life are carried out to this end. As a result, the preciseness of the carried out calculations of the service life can be significantly raised again. This can be traced back in particular to the fact that upon a loading incident, i.e., during the carrying out of a concluded work project (for example, of a ground borehole, a bursting process or of a pipe drawing-in process) the individual linkage lengths are loaded with different times as a function of the time at which they were incorporated into the linkage. In addition, the individual linkage lengths are used in a plurality of work procedures, wherein as a rule it cannot be, retained which linkage length was used in which work project and how long it was loaded in it. This now becomes possible according to the invention by the preferred, individual measuring and taking into consideration the loading of the individual linkage length and by a corresponding evaluation. To this end the values for the individual linkage lengths are preferably separately stored, wherein this can take place in an especially preferred manner in a storage element which is itself connected to the particular linkage length. It can be excluded by provided individual or all linkage lengths with appropriate storage elements that the individual measurements and calculations of service life are exchanged. In addition, an expensive data management is eliminated if the different linkage lengths are mixed and used at different construction sites for different work projects.

The concept "storage element" in the sense of the invention relates to any data store or a storage medium which can be written to and/or read out in particular electronically. The storage element can store information on the basis of electronic semiconductor components or other components. The storage element can be in particular a non-volatile memory. A contactless reading out and/or writing of data to the storage element is preferred. A storage element can preferably be an RFID chip which customarily comprises an antenna, an analog circuit and a digital circuit and a permanent memory. The RFID chip can be a passive, active or semi-active RFID chip.

However, it is also possible to centrally store the values for the individual linkage lengths and to provide each linkage length with an identifiable code (for example a series number of the linkage length which is, for example optically determined) which code is then associated with the centrally stored values.

The transmission of the measured load and/or of the individual calculations of service life of a loading incident can preferably be transmitted onto the individual storage elements by the drive device (a device or apparatus integrated in the drive device) or by a device adjacent to the drive device (an additional device which can execute steps which make possible, for example, at least (partial) tasks of the calculation of the service life or (partial) tasks to be carried out in this connection, for example, as a module to be additionally purchased). This can then take place in an especially preferred manner if the particular linkage length is present for being incorporated into or for being moved out of the linkage strand in the drive device. To this end, a transmission device can preferably be provided on the device side (integrated on or into the drive device or separately to it) which serves for the transmission of the measured loads and/or of the results of the calculations of the service lives to the storage elements of the linkage lengths. The transmission device is preferably arranged on the drive device or integrated in or on the latter. The transmission device can also be added separately to the drive device, for example, the drive device can by supplemented or enhanced by the possibility of a service life calculation.

The transmission of the measured loading or of the individual calculations of the service life of a loading incident can especially preferably take place for a linkage loaded by traction which comprises a plurality of interconnected linkage lengths if the linkage is drawn step-by-step by the drive device through a borehole in the ground area, wherein the individual linkage lengths are drawn successively out of the ground bore and loosened from the remainder of the linkage in that the transmission of the loads or of the results of the calculations of the service life to the storage element of the linkage length to be loosened takes place shortly before, during the loosening of this linkage length or shortly thereafter, in particular as long as the latter is still present in the area of the drive device.

In order to be able to also take into account the loads to which the individual linkage lengths were exposed in preceding loading cases during the carrying out of the calculation of the service life, it can furthermore be provided that the loads or the results of the calculation of the service life stored in the storage elements of the individual linkage lengths are at first transmitted to the drive device or to an external device (module), and then updated in the drive device or the external device (module) with the loads (for example with the number of drive strokes with the particular force values and/or the bending load) or with the calculation of the service lives of the last loading incident, and the updated values are against stored in the storage elements. In this manner the aging of the individual linkage lengths at the current construction site can be calculated with those on the previous construction sites.

The invention also creates a ground drilling device with a linkage section. The linkage section is equipped for measuring bends and a data connection can be established between the linkage section and a receiving device of the ground drilling device. A bending load which acts on the linkage and/or on the individual linkage lengths can be determined with the linkage section. The linkage section follows the course of the linkage in order to determine the ground bore and can therefore indicate with to which bending the individual linkage sections are being subjected to during the progressive movement through the ground borehole. The measuring of the bending takes place in a real manner by the linkage section arranged in the linkage. The linkage section can preferably be arranged in the front area of the linkage, behind the drilling head, i.e., directly following the drilling head. However, intermediate sections can also be provided between the drilling head and the linkage section. An arrangement of the linkage section in the front area is desirable in order that it can be determined with the linkage section how the ground bore is progressing, i.e., which loads are also present in the front area of the ground bore.

The "receiving device" in the sense of the specification is a device which can receive a signal for bending or expansion from the linkage section, which can be a measure for the bending load. The receiving device can be arranged on the linkage section and/or in the area of the drive device. The signal can be transmitted to the receiving device as a raw signal or as an at least already evaluated signal.

The linkage section can be present as part of the linkage or drill string in the latter. The linkage section can comprise connection elements with which the linkage section can be connected to other sections of the linkage or of the drill string. The linkage section can be connected in particular to the drilling head, a sensor section, which can serve for orientation, and/or to a linkage length. Plug connections and screw connections are possible and are adapted to the other sections. A detachable connection has the advantage of a simple and rapid replacement.

In addition to the linkage section for measuring bends and to the receiving device of the ground drilling device, a reading-writing device (transmission device) can be provided with which the data stored on the storage elements and concerning earlier loads and/or earlier results of the calculating of the service lives can be read out. The reading-writing device can be designed to be active to this end, i.e., it reads out the data stored in a passive storage element. Alternatively, the reading-writing device can also cooperate with active storage elements which send the desired values to the reading-writing device.

The reading-writing device can be part of the receiving device or vice versa. The reading-writing device and/or the receiving device can be controlled by the control of the ground drilling device and can be functionally coupled to the control. A reading-writing device which is present separately from the ground drilling device and which evaluates, for example, the ground drilling device regarding the carrying out of the calculation of the service lives is possible.

The data connection between the linkage section and a receiving device can take place wirelessly, for example, by means of any data-transfer technologies (for example, radio transmission and/or infrared data transmission, etc.). A wireless transmission comprises every at least sectionally contactless transmission of data, signals and/or energy. The data connection can also be designed to be wired, which makes possible a simple design and can reduce the influence of disturbances.

In a preferred embodiment at least one expansion sensor is present on the linkage section and whose signal can be transmitted as a measure of the bending load by the data connection to the receiving device.

An "expansion sensor" in the sense of the specification is an element which can make available in particular signals which are correlated with an expansion or bending. An expansion sensor can be a passive structural component which can generate signals but optionally only using a stimulation or in response to a signal, energy, an impulse or the like supplied to the expansion sensor. Expansion sensors can be measuring devices with which expanding and compressing deformations can be detected. For example, these expansion sensors, to the extent that they are constructed as wire strain gauges, can change their electrical resistance upon slight deformations. An expansion sensor can be connected especially with an adhesive, cement or a similar substance in a firmly bonded manner to the linkage section, especially to the rod-shaped section of the linkage section, which can minimally deform under load. The deformation (expansion or compression) results in a changing of a signal, in particular of the resistance of the expansion sensor. The concept "expansion sensor" can comprise various receiver types such as, for example, force receivers, pressure receivers or also torque moment receivers. An expansion sensor can be designed as a wire strain gauge. The wire strain gauges can for their part be arranged as foil, wire- and semiconductor wire strain gauges and as multiple wire strain gauges in various embodiments such as wire strain gauges with transverse expansions, full bridge wire strain gauges and rosette wire strain gauges. A construction as fiber-Bragg grating is also alternatively or additionally possible. An optical waveguide can be used here into which an optical interference filter is inserted and with which an expansion is detected based on the changing, coupled-in and reflected wavelength.

The signal of an expansion sensor is correlated with a compressing or expanding deformation. The signal magnitude can supply a conclusion about the magnitude of the deformation. The signal can be evaluated by an evaluation unit and the corresponding load can be calculated. The evaluation unit can be arranged in front of or after the receiving device in the signal flow. The evaluation unit can also be a part of the receiving device and/or of an expansion sensor. The evaluation device can convert the signal received from the expansion sensor into a bending load, expansion load and/or curvature load or calculate and/or display a value correlated with them.

In a preferred embodiment the linkage section has a rod-shaped section on which at least one expansion sensor is arranged. One expansion sensor on the linkage sensor can be sufficient. Multiple expansion sensors, i.e., two, three or an even greater number of expansion sensors can furnish a redundancy and/or an elevated precision. Several expansion sensors can be arranged on the linkage section distributed in the longitudinal direction and/or distributed in the circumferential direction. In particular, expansion sensors can be provided on an area of the linkage section which substantially corresponds to the middle area of the linkage section relative to the longitudinal extension of the linkage section. The greatest bending loads can act in this middle area on the linkage section and the arrangement of the expansion sensor is therefore especially sensitive in this area.

The concept "on" denotes in the sense of the specification a spatial arrangement of an expansion sensor on the linkage section in such a manner that that the expansion sensor or at least a part of the embodiment is connected to the linkage section or is fastened to the linkage section. The expansion sensor or the expansion sensors can be fastened on the outside of the linkage section. A fastening in recesses of the linkage section on the outside is possible. An arrangement on an inner side is also possible. Several expansion sensors can be arranged in different manners on the linkage section, for example, at least one on the inner side, at least one on the outer side and/or at least one on a recess on the outer side. The arrangement of an expansion sensor in a recess offers the possibility of an improved protection of the expansion sensor since it is not directly present on the surface but rather is offset from it. The expansion sensor can also be arranged on the sensitive section of the linkage section which is, for example, structurally different than the remaining linkage section or is constructed from a different material; for example, the expansion sensor can be arranged on a section of the linkage section which is constructed with a thin wall. The linkage section on which the expansion sensor is arranged can be manufactured especially from steel. The material or the linkage section on which the at least one expansion sensor is present is especially preferably manufactured from a material with isotropic behavior in order to prevent any preferred direction during the bending load.

In a preferred embodiment the linkage section comprises a protective casing in which the rod-shaped section is arranged. As a consequence, the harsh conditions present in the ground area can be taken into account. The rod-shaped section which receives the bending loads and which can have in particular a smaller cross section than the remaining part of the linkage can be protected. In particular, the protective casing can protect an expansion sensor fastened on the rod-shaped section from the ground area. The expansion sensor is not exposed in the ground area by the using of a protective casing. The protective casing can substantially have a diameter which is similar to linkage lengths which are adjacent in the drill string. The protective casing can consist of metal or a plastic. The protective casing can be detachably fixed on the rod-shaped section by a detachable fixing, wherein in particular a shifting of the protective casing relative to the rod-shaped section is possible by loosening the fixing in order, for example, to replace the expansion sensor, the protective casing and/or the rod-shaped section.

In a preferred embodiment the rod-shaped section is hollow, as a result of which a geometry especially sensitive to bending loads can be created.

The invention also creates a usage to determine wear to a linkage of a ground drilling device, wherein a linkage section is designed for measuring a bending which is used to detect a bending load of the linkage. In particular, the bending load which is obtained by using the linkage section for measuring a bending can be used for calculating the service life of a linkage, in particular of individual linkage lengths of the linkage.

Explanations regarding the different aspects concerning the method, the ground drilling device and the usage are to be understood as supplementing each other, wherein explanations concerning an aspect also apply to embodiments of another one of the three aspects and are therefore also disclosed for another one of the aspects. For example, method steps can be carried out by the structural and body embodiments of the device, wherein the method steps described relative to the method for the execution can condition a body design in the form of body devices and/or apparatuses and components.

The previous explanation as well as the following description of exemplary embodiments do not exclude certain embodiments or features.

BRIEF DESCRIPTION OF THE DRAWINGS

The invention is explained in detail in the following using an exemplary embodiment shown in the drawings.

DETAILED DESCRIPTION

Figure 1:
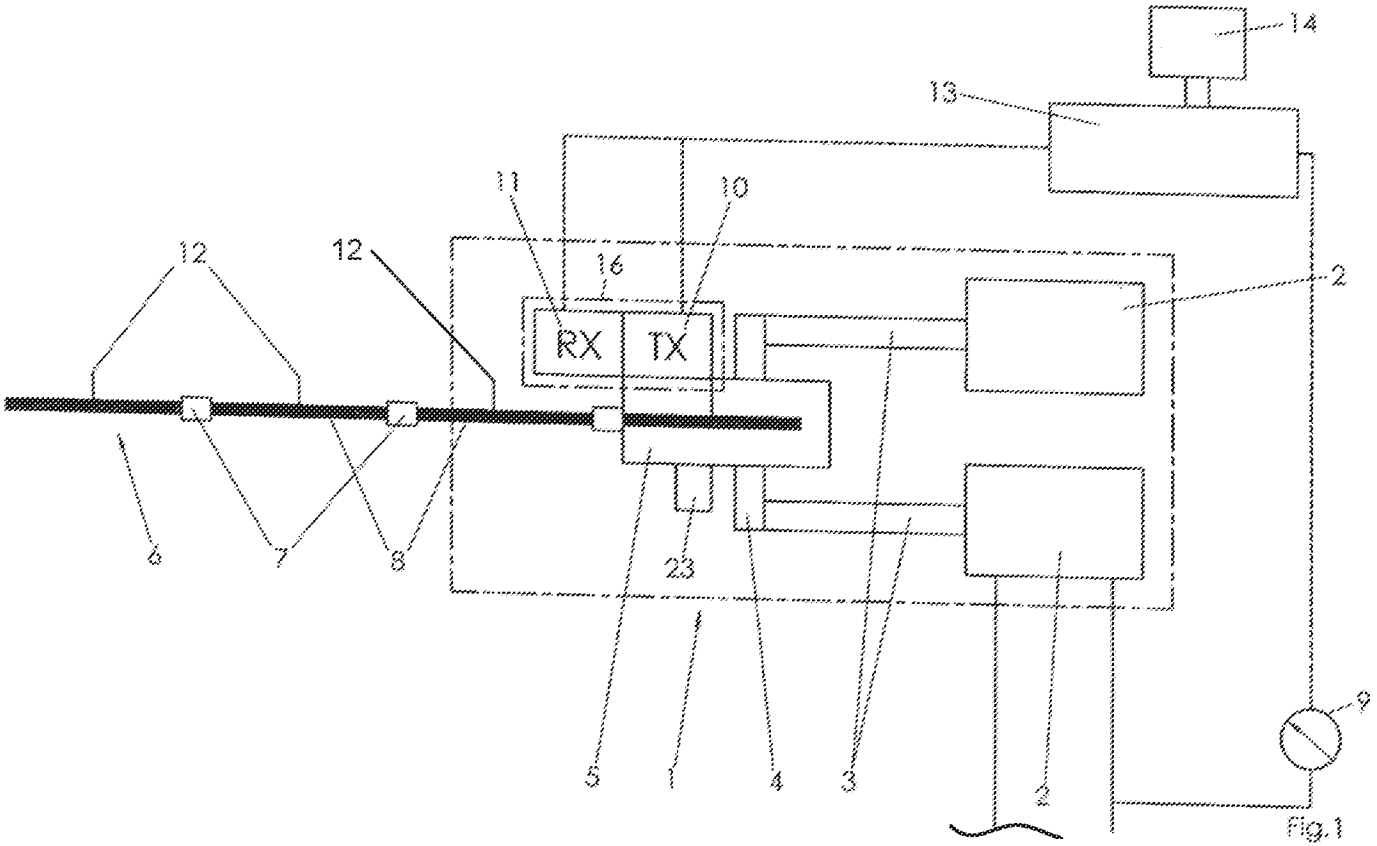
FIG. 1 shows a ground drilling device in a schematic view.

FIG. 1 shows a schematic view of a ground drilling device. The ground borehole device comprises a drive device 1 with two hydraulic cylinders 2 operated in parallel and whose piston rods 3 transmit a linear movement onto a linkage 6 of the ground drilling device via a pressure bridge 4 and the coupling element 5 associated with the latter. The transmission takes place step-by-step in that the hydraulic cylinders 2 of the drive device 1 cyclically execute a working and a return stroke.

The ground drilling device with the drive device 1 is suitable for a pushing as well as for a drawing operation. The linkage 6 comprises a plurality of linkage lengths 8 connected to each other by couplings 7.

Figure 2:
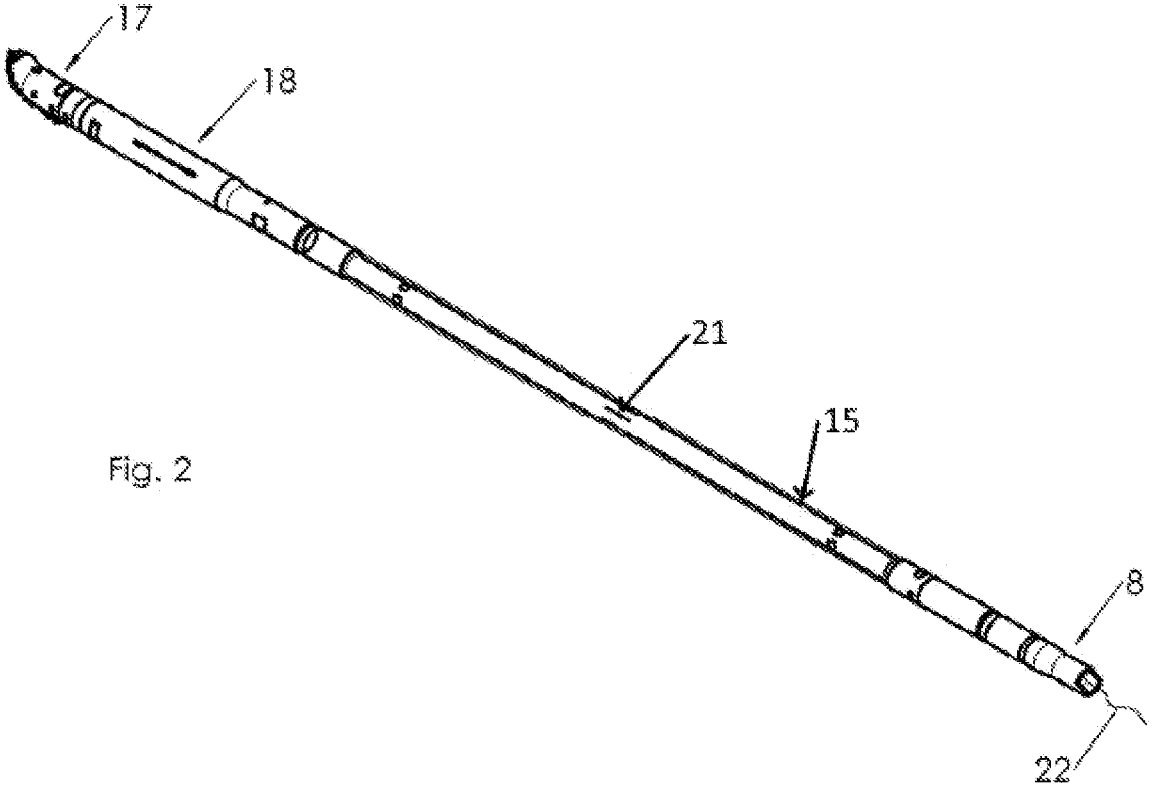
FIG. 2 shows an end area of the linkage of the ground drilling device in FIG. 1.
Figure 3:
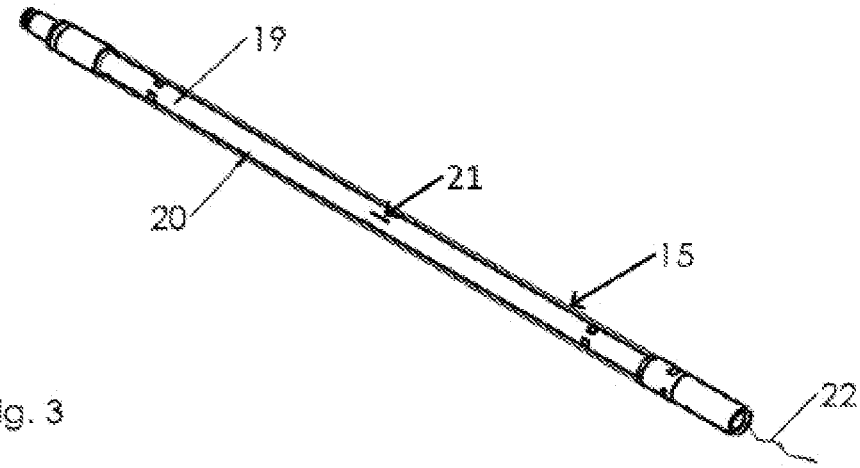
FIG. 3 shows a detailed view of a linkage section in FIG. 2.

The ground drilling device comprises a detection apparatus for detecting an instantaneous loading of the linkage which apparatus comprises a pressure sensor 9 and the linkage section 15 shown in FIG. 2 and FIG. 3 which is described in detail in conjunction with the FIGS. 2 and 3.

Furthermore, the ground drilling device shown in FIG. 1 comprises an evaluation apparatus 13 for carrying out a service life calculation for the linkage.

The hydraulic pressure in one or also in both of the hydraulic cylinders 2 can be measured by the pressure sensor 9. The hydraulic pressure is proportional to the forces of pressure and traction exerted on the linkage 6. The hydraulic pressure is transmitted to a computer unit of the evaluation apparatus 13.

The ground drilling device additionally comprises a transmission apparatus 16 which comprises in the exemplary example shown a writing unit 10 and a reading unit 11. Data can be written to and read out from storage elements 12, of which one of them is fastened on each of the linkage lengths 8, by the transmission apparatus 16. The writing unit 10 as well as the reading unit 11 are connected to the evaluation apparatus 13.

The ground drilling device makes it possible to determine the individual loads to which the individual linkage lengths 8 are exposed and to perform individual service life calculations from this. To this end the data stored on the corresponding storage element 12 (optionally at previous usages of this linkage length 8 which already took place) is read out by the reading unit 11 for each of the linkage lengths 8 shortly before the decoupling. Based on the work procedure in which the linkage length 8 was used, the load exerted on the linkage length 8 is determined by the evaluation apparatus 13, wherein the data of the pressure sensor 9 and of the data detected on the linkage section 15 is evaluated for the determination. Starting from these concrete values, an individual service life calculation can be carried out for each individual one of the linkage lengths 8 of the linkage 6 in the evaluation unit 13. The result of the service life calculation, in which in addition to the current working procedure even all previous loads of the particular linkage length 8 are considered, is again stored by the writing unit 10 on the storage element 12 of the particular linkage lengths 8, which element is designed as an RFID chip, so that this data is available again in a subsequent usage of the corresponding linkage length 8 and can be considered in a subsequent updating of the service life calculation. An appropriate service life calculation is carried out for each of the linkage lengths 8 of the linkage 6. Different results can result for all of the linkage lengths 8 depending on the position at which they are or were incorporated into the linkage 6. For example, the first linkage length 8 of the linkage 6 which is directly connected to the drilling head is loaded the longest since it is coupled on as the first linkage length and decoupled again as the last one (for example, when carrying out a pilot bore and withdrawing the linkage with a widening-out head).

The following data can be stored on the RFID chip in one embodiment:

production order number,
average pressure,
fissure check yes/no,
Remaining service life
total stroke number,
stroke number per load horizon (8 times),
total previous damage,
most damaging load horizon,
expected service life at full load,
expected service life at an average load.

In the embodiment of a ground drilling device shown in FIG. 1 the device comprises a monitor 14 on which the result of the service life calculation as it is stored during the decoupling of each linkage length 8 on the corresponding RFID chip is shown. This makes it possible for the user of the ground drilling device to read off the information shown there regarding the service life to be expected for the particular linkage length 8. As a result thereof, for example, linkage lengths 8 whose expected service life is no longer long enough for a subsequent use can be directly separated out. In addition, the individual linkage lengths 8 can be sorted according to their expected service life after the decoupling and appropriately stored. In this manner it is made possible, for example, in subsequent work projects to couple those linkage lengths 8 which have only a short expectation of service life late on the linkage 6 in order to keep the additional loads on these linkage lengths 8 low and/or to be able to rescue such a linkage length 8 rapidly and in a simple manner for the case that it is destroyed. There is also the possibility of providing a portable managing device which comprises at least an appropriate reading unit and a display. With this portable managing device the storage elements 12 of stored linkage lengths 8 can also be read out independently of the drive device 1 in order to be able to appropriately plan the future use of the individual linkage lengths 8. The read-out values can be used, for example, for an inventory or also for preparing renting lists, etc.

FIG. 2 schematically shows an oblique rear view of a front area of the drill string with linkage lengths 8 and a drilling head 17. The transmitting section 18 with a transmitter is arranged between the drilling head 17 and the linkage lengths 8 which transmitter is followed by the linkage section 15. The transmitter in the transmitter section 18 serves to localize the drilling head 17 and for localizing the drill string. The drilling head 17 with following transmitter section 18 and linkage section 15 as well as the linkage lengths 8 follow the ground borehole which is carried out in the ground. The curvature of the course of the ground borehole can be detected with the linkage section 15. The linkage section 15 detects a bending load. The linkage section 15 is shown on an enlarged scale in FIG. 3. The linkage section 15 comprises a rod-shaped section 19 whose diameter is smaller than the diameter of the linkage lengths 8. The rod-shaped section 19 is surrounded by a protective casing 20 which substantially comprises an outer dimension corresponding to the dimension of drilling head 17 and transmitter section 18. The protective casing 20 protects the rod-shaped section, which is designed to be hollow. In particular, the protective casing 20 protects expansion sensors 21 arranged on the rod-shaped section 19 which are substantially fastened centrally as regards the longitudinal extension of the rod-shaped section 19 to the latter.

The embodiment shown in FIGS. 2 and 3 shows a cable 22 for connecting to a receiving device 23 which transmits the data to a control of the ground drilling device or to the evaluation device 13. Instead of a cable 22 shown in FIGS. 2 and 3, a wireless transmission of the values of the expansion sensors 21 to the receiving device 23 can take place. The receiving device 23 is connected to the evaluation device 13 by cable or in a wireless manner. The receiving device 23 transmits the signals of the expansion sensor 21 to the evaluation device 13 in an evaluated form and/or in a raw version so that the evaluation device 13 can perform a service life calculation for the linkage and/or the individual linkage length 8 with inclusion of the data of the pressure sensor 9.

The invention claimed is:

1. A method for determining wear on a linkage of a ground drilling device, comprising detecting, in a ground bore by a sensor on at least one linkage section of the linkage, a bending load on the at least one linkage section and using the bending load to carry out a service life calculation for a plurality of linkage lengths of the linkage;

wherein detecting the bending load by the sensor on the at least one linkage section in the ground bore comprises detecting, in the ground bore, the bending load by at least one expansion sensor arranged on a rod-shaped section of the at least one linkage section protected by a protective casing in which the rod-shaped section is arranged, wherein the rod-shaped section has a smaller cross-section than a cross-section of the plurality of linkage lengths of the linkage.

2. The method according to claim 1, wherein the expansion sensor comprises at least one of a wire strain gauge or a fiber-Bragg grating sensor.

3. The method according to claim 1, wherein the service life calculation is based in part on a position of the linkage length in the linkage.

4. The method according to claim 1, wherein the rod-shaped section of the at least one linkage section is in line with the linkage lengths.

5. The method according to claim 1, wherein the sensor on the rod-shaped section of the at least one linkage section is arranged on a middle portion of the rod-shaped section of the at least one linkage section.

6. The method according to claim 1, wherein the protective casing protecting the at least one linkage section is detachably fixed to the rod-shaped section of the at least one linkage section.

7. A ground drilling device, comprising a linkage and at least one linkage section connected to the linkage, wherein the at least one linkage section comprises an expansion sensor for measuring a bending load on the at least one linkage section when it is in a borehole, wherein a data connection can be established between the at least one linkage section and a receiving device to transmit the bending load measured on the at least one linkage section to carry out a service life calculation for a plurality of linkage lengths, where the sensor is arranged on a rod-shaped section of the at least one linkage section protected by a protective casing in which the rod-shaped section is arranged, the rod-shaped section having a smaller cross-section than a cross-section of the plurality of linkage lengths of the linkage.

8. The ground drilling device according to claim 7, wherein a signal from the sensor can be transmitted by the data connection to a control.

9. The ground drilling device according to claim 7, wherein the rod-shaped section of the at least one linkage section is in line with the linkage lengths on which at least one sensor is arranged.

10. The ground drilling device according to claim 9, wherein the rod-shaped section is hollow.

11. The ground drilling device of claim 7, wherein the protective casing is detachably fixed to the rod-shaped section of the at least one linkage section.

12. A method for determining wear on a plurality of linkages of a ground drilling device, comprising detecting, in a ground bore by a sensor on each of the plurality of linkages, a bending load on each of the plurality of linkages and using the bending loads to carry out service life calculations for a plurality of linkage lengths of the linkage;

wherein detecting the bending load by the sensor on each of the plurality of linkages in the ground bore comprises detecting, in the ground bore, the bending load by at least one expansion sensor arranged on a rod-shaped section of each of the plurality of linkages, wherein each rod-shaped section is protected by a detachably fixed protective casing fixed to the rod-shaped section, wherein the rod-shaped section has a smaller cross-section than a cross-section of the plurality of linkage lengths of the linkage.

* * * * *